US006484392B1

(12) United States Patent
Okada et al.

(10) Patent No.: US 6,484,392 B1
(45) Date of Patent: Nov. 26, 2002

(54) METHOD OF PRODUCING COAXIAL CABLE

(75) Inventors: Yoichi Okada, Nagano (JP); Yasushi Ooshima, Nagano (JP)

(73) Assignee: Totoku Electric Co., Ltd., Tokyo (JP)

( * ) Notice: Subject to any disclaimer, the term of this patent is extended or adjusted under 35 U.S.C. 154(b) by 0 days.

(21) Appl. No.: 09/514,523

(22) Filed: Feb. 28, 2000

(30) Foreign Application Priority Data

Oct. 29, 1999 (JP) ..... 11-308863

(51) Int. Cl.[7] ..... H01B 13/20

(52) U.S. Cl. ..... 29/828; 29/728; 29/33 F; 174/102 R

(58) Field of Search ..... 29/828, 868, 863, 29/33 F, 825; 174/102 R, 28, 29, 102 P, 728; 219/549; 439/578, 584

(56) References Cited

U.S. PATENT DOCUMENTS 2,446,387 A * 8/1948 Peterson ..... 174/105
3,639,674 A * 2/1972 Stier ..... 174/36
4,083,484 A * 4/1978 Polizzano et al. ..... 228/130
4,486,252 A * 12/1984 Lloyd ..... 156/51
5,212,350 A * 5/1993 Gebs ..... 174/102 R
5,220,130 A * 6/1993 Walters ..... 174/36
5,283,082 A * 2/1994 Hussman et al. ..... 427/118
5,493,070 A * 2/1996 Habu ..... 174/102 R
5,558,794 A * 9/1996 Jansens ..... 219/549
5,802,710 A * 9/1998 Bufanda et al. ..... 29/828
5,813,106 A * 9/1998 Haug et al. ..... 29/429
6,009,621 A * 1/2000 Nishi et al. ..... 29/857

FOREIGN PATENT DOCUMENTS

| | | | |
|---|---|---|---|
| EP | 0385549 | | 9/1990 |
| JP | 2001250441 A | * | 9/2001 |
| WO | WO9813835 | | 4/1998 |

* cited by examiner

*Primary Examiner*—Carl J. Arbes
*Assistant Examiner*—Minh Trinh
(74) *Attorney, Agent, or Firm*—Jordan and Hamburg LLP

(57) ABSTRACT

A process of weaaving metal conductor wires to form a metal woven shielding conductor layer over the outer surface of an insulated cable. The insulated cable is accompanied with at least one solder or tin wire. When the at least one solder or tin wire is immersed in a molten metal plating solution, it melts down hence generating a spatial margin between the insulated cable and the metal woven shielding conductor layer. This prevents the insulated cable from biting with its outer surface into the metal woven shielding conductor layer when it is thermally expanded in the molten metal plating solution. As the metal woven shielding conductor layer is impregnated deeply with the molten metal, there are hardly any generated gaps and undulation on the surface of the metal plating layer. Accordingly the suppression of reflection and attenuation of a transmission signal will be improved.

2 Claims, 8 Drawing Sheets

Fig. 1
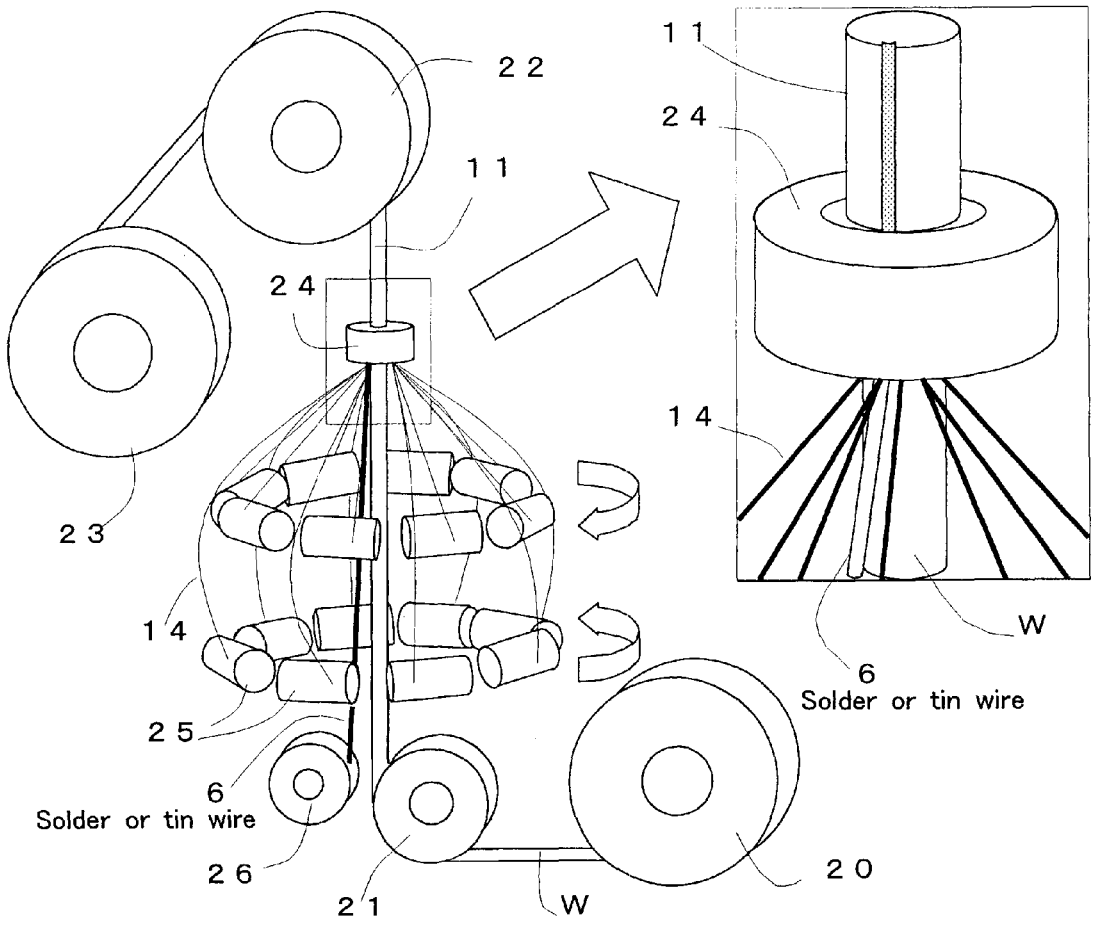
Fig. 2 Intermediate cable 11
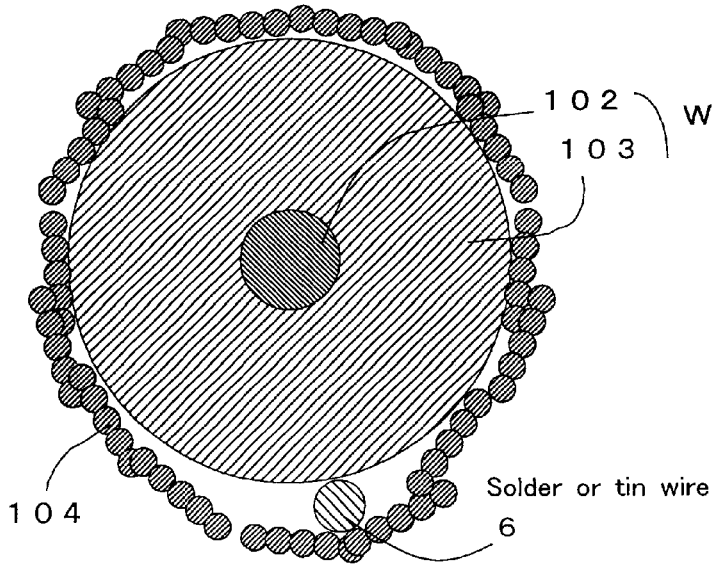

Fig. 3
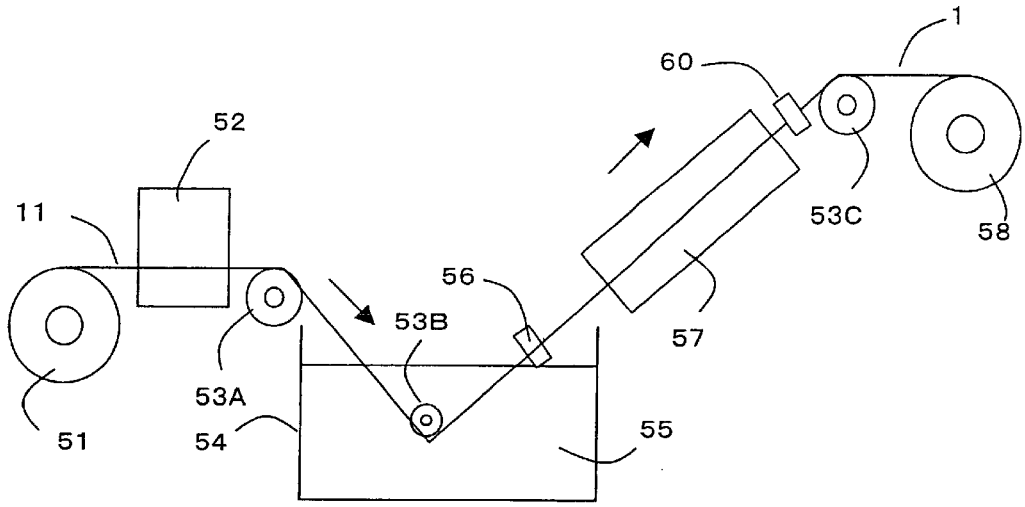
Fig. 4 Coaxial cable 1
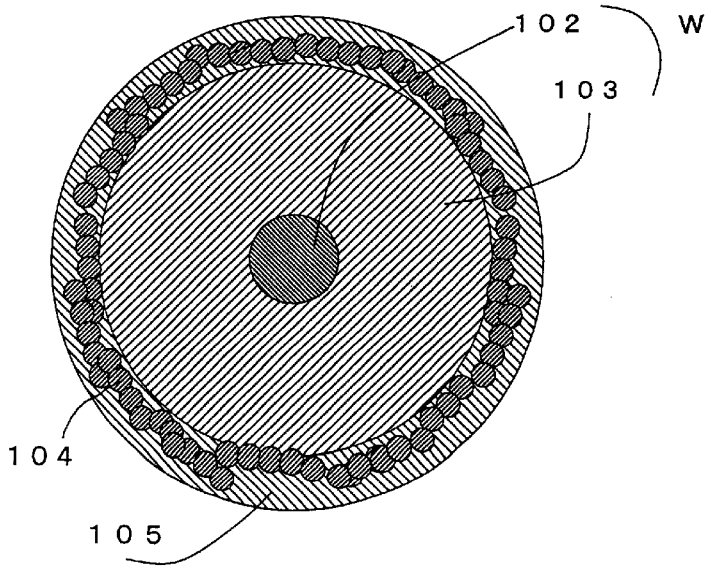

Fig. 8
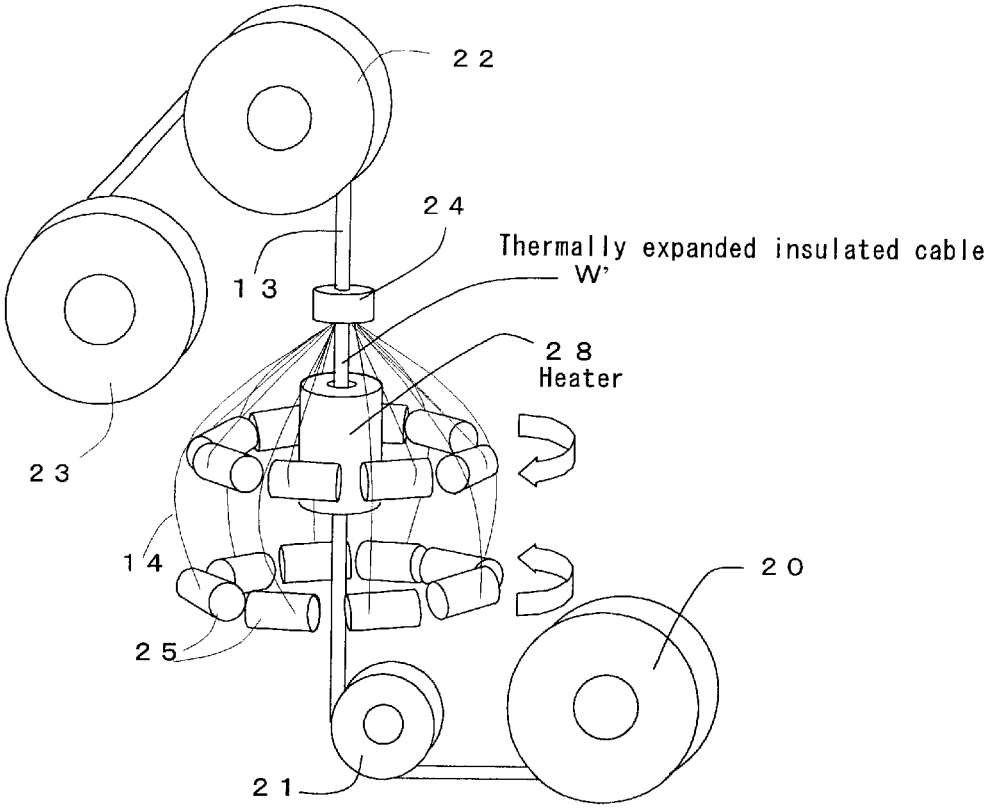
Fig. 9 Intermediate cable 13
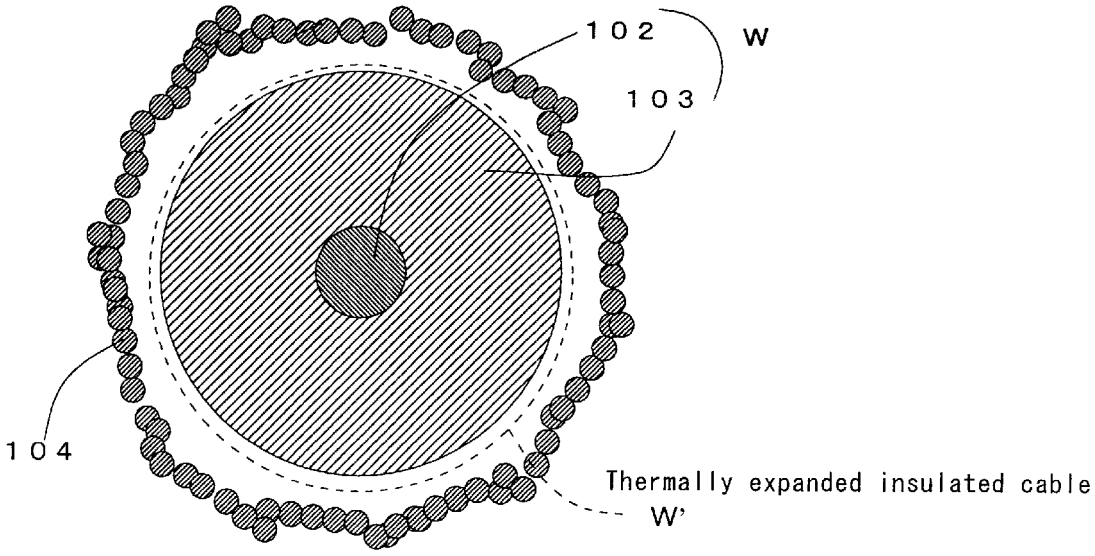

Intermediate cable 111

Prior Art

Fig. 12
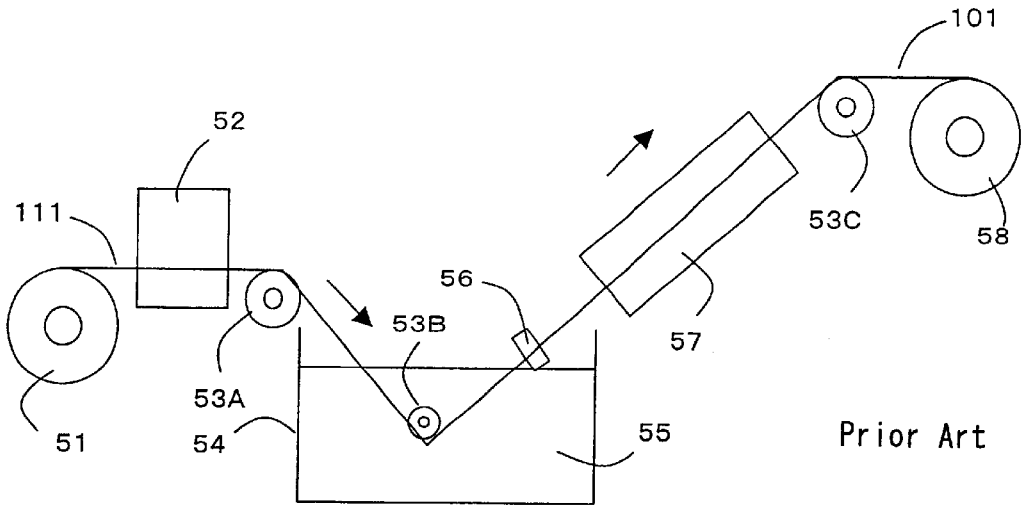
Fig. 13 Coaxial cable 101
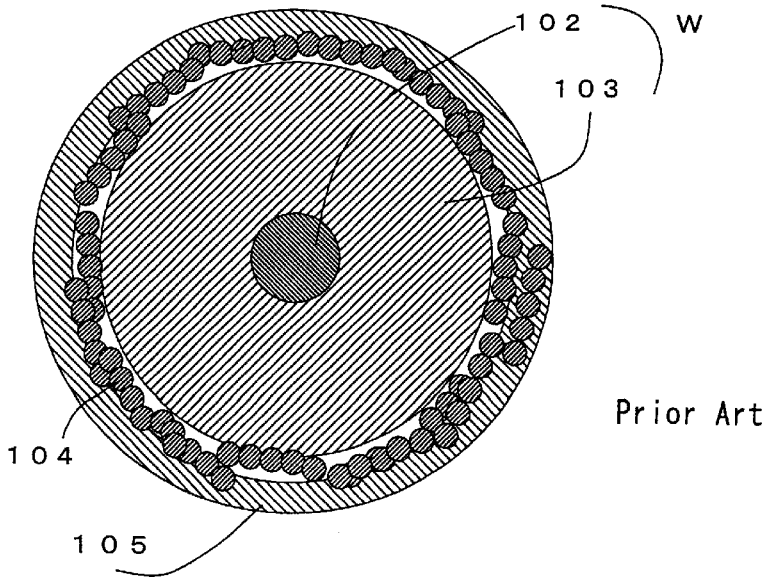

METHOD OF PRODUCING COAXIAL CABLE

BACKGROUND OF THE INVENTION

1. Field of the Invention

The present invention relates to a coaxial cable producing method and a coaxial cable and particularly, to a method of producing a coaxial cable of which the metal plating layer formed by impregnating a metal woven shielding conductor layer with a molten metal is improved at its inner surface in the smoothness and thus its adhesivity to an insulated cable is increased and to such a coaxial cable.

2. Description of the Prior Art

As high frequency coaxial cables enhanced in the electric characteristics including the suppression of reflection and attenuation in a high frequency range, semi-rigid type coaxial cables are known in which an insulated cable produced by coating a center conductor with an insulator layer is coaxially covered at its outer surface with a metal pipe made of, for example, copper or aluminum.

The semi-rigid type coaxial cables using the metal pipe are however high in the production cost and poor in the flexibility, hence making the wiring operation difficult.

Alternatively, modified coaxial cables which are decreased in the production cost and improved in the flexibility although their electric characteristics including the suppression of reflection and attenuation are lower than those of the semi-rigid type coaxial cables using the metal pipe have been proposed comprising an insulated cable produced by coating the outer surface of a center conductor with an insulator layer and covered with a metal woven shielding conductor layer and a metal plating layer produced by passing the insulated cable through a molten metal plating solution to impregnate the metal woven shielding conductor layer with a molten metal.

FIG. 10 is an explanatory view showing a process of forming the metal woven shielding layer in a modified coaxial cable producing method using the molten metal plating.

An insulated cable W formed by coating the outer surface of a center conductor (102 in FIG. 11) with an insulator layer (103 in FIG. 11) with the use of a common means at the previous step is released from a supply reel 20, passed on a guide roll 21, and directed into a dice 24.

Also, a group of metal conductor wires 14 are woven with reels 25, on which the metal conductor wires 14 are wound, spinning about the insulated cable W at the entrance of the dice 24 to form a metal woven shielding conductor layer (104 in FIG. 11) over the outer surface of the insulated cable W.

A resultant intermediate cable 111 having the metal woven shielding conductor layer (104 in FIG. 11) covered over the outer surface of the insulated cable W is drawn by the action of a drawing capstan 22 and taken up on a take-up reel 23.

FIG. 11 is a cross sectional view of the intermediate cable 111.

The metal woven shielding conductor layer 104 of the intermediate cable 111 is closely bonded to the outer surface of the insulated cable W.

FIG. 12 is an explanatory view showing a process of forming a metal plating layer in the method of producing a coaxial cable using the molten metal plating.

The intermediate cable 111 is released from a supply reel 51, coated with a flux by a flux coating apparatus 52, guided by a guide roller 53A, and directed into a molten metal plating solution 55 in a molten metal plating tub 54. Then, the cable is guided by a guide roller 53B in the molten metal plating tub 54, moved out from the molten metal plating solution 55, passed through a plating solution squeezing dice 56 disposed above the molten metal plating solution 55 for adjusting to a desired thickness of the plating, cooled down by a cooling apparatus 57 to complete a coaxial cable 101, guided by a guide roller 53C, and taken up on a take-up reel 58.

FIG. 13 is a cross sectional view of the coaxial cable 101 produced by the coaxial cable producing method using the molten metal plating.

The coaxial cable 101 comprises the insulated cable W formed by coating the center conductor 102 with the insulator layer 103 and the metal plating layer 105 formed on the insulated cable W by impregnating the metal woven shielding conductor layer 104 with the molten metal.

FIG. 14 is an exemplary diagram of the attenuation and reflection characteristics of a transmission signal on the coaxial cable 101.

A one-meter length of the coaxial cable 101 was prepared and its reflection and attenuation characteristics at a high frequency range from 0.045 GHz to 18 GHz were measured with a network analyzer.

Peaks of the reflection and the attenuation which may result from the effect of a winding pitch of the metal woven shielding conductor layer 104 are shown at about 10 GHz of a transmission frequency.

Also, the standing wave ratio of a reflected voltage at a high frequency range from 0.045 GHz to 18 GHz is 1.4.

SUMMARY OF THE INVENTION

In the conventional method of producing a coaxial cable using the molten metal plating, the metal woven shielding conductor layer 104 is adhered closely to the outer surface of the insulated cable W during the step of forming the intermediate cable 111 as shown in FIG. 11. When the intermediate cable 111 is immersed in the molten metal plating solution 55, for example, at 260° C., the insulator layer 103 made of a resin material is thermally expanded hence biting into the metal woven shielding conductor layer 104. This causes the metal woven shielding conductor layer 104 to be hardly impregnated with the molten metal. Accordingly, when the insulator layer 103 is cooled down and returns to its original size, portions of the metal woven shielding conductor layer 104 are exposed from the inner surface of the metal plating layer 105 thus generating gaps and undulations of the surface.

If there are generated gaps and undulations of the inner surface of the metal plating layer in which a high frequency current runs, the high frequency characteristic may be declined. More particularly, peaks of the reflection and attenuation which may result from the effect of a winding pitch of the metal woven shielding conductor layer 104 appear about at 10 GHz of the transmission frequency, hardly ensuring the effectiveness within a frequency range including 10 GHz.

In addition, the adhesivity between the insulated cable W and the metal plating layer 105 is poor, causing the metal plating layer 105 to be easily slipped out.

It is an object of the present invention to provide a coaxial cable producing method and a coaxial cable of which the metal plating layer formed by impregnating a metal woven shielding conductor layer with a molten metal is improved at its inner surface in the smoothness and its adhesivity to the insulated cable is increased.

As a first aspect of the present invention, a method of producing a coaxial cable is provided comprising the steps of covering with a metal woven shielding conductor layer an insulated cable formed by coating the outer surface of a center conductor with an insulator layer, and passing the cable through a molten metal plating solution to impregnate the metal woven shielding conductor layer with a molten metal to have a metal plating layer, said step of covering with the metal woven shielding conductor layer being arranged in which the insulated cable is accompanied with one or more solder or tin wires while the metal woven shielding conductor layer is being woven.

In the method of producing a coaxial cable as the first aspect, when the intermediate cable having the insulated cable associated with one or more solder or tin wires is immersed in the molten metal plating solution, the solder or tin wires are dissolved into the molten metal plating solution thus generating a spatial margin between the insulated cable and the metal woven shielding conductor layer. This prevents the insulator layer from biting into the metal woven shielding conductor layer when it is thermally expanded. Accordingly, as the metal woven shielding conductor layer is impregnated deeply with the molten metal, there are generated no gaps or undulations on the inner surface of the metal plating layer. Hence, the coaxial cable will be improved in the suppression of reflection and attenuation of a transmission signal. Also, the metal plating layer will hardly be slipped out.

As a second aspect of the present invention, a method of producing a coaxial cable is provided comprising the steps of covering with a metal woven shielding conductor layer an insulated cable formed by coating the outer surface of a center conductor with an insulator layer, and passing the cable through a molten metal plating solution to impregnate the metal woven shielding conductor layer with a molten metal to have a metal plating layer, said step of covering with the metal woven shielding conductor layer being arranged in which one or more spacer wires are provided between the insulated cable and the metal woven shielding conductor layer during the weaving action and removed out when the weaving action is completed.

In the method of producing a coaxial cable as the second aspect, one or more of the spacer wires are removed from the insulated cable when the weaving action has been finished, thus generating a spatial margin between the insulated cable and the metal woven shielding conductor layer in the intermediate cable. This prevents the insulator layer from biting into the metal woven shielding conductor layer when it is thermally expanded as the intermediate cable is immersed in the molten metal plating solution. Accordingly, since the metal woven shielding conductor layer is impregnated deeply with the molten metal, there are generated no gaps or undulations on the inner surface of the metal plating layer. Hence, the coaxial cable will be improved in the suppression of reflection and attenuation of a transmission signal. Also, the metal plating layer will hardly be slipped out.

As a third aspect of the present invention, a method of producing a coaxial cable is provided comprising the steps of covering with a metal woven shielding conductor layer an insulated cable formed by coating the outer surface of a center conductor with an insulator layer, and passing the cable through a molten metal plating solution to impregnate the metal woven shielding conductor layer with a molten metal to have a metal plating layer, said step of covering with the metal woven shielding conductor layer being arranged in which the metal woven shielding conductor layer is woven while the insulated cable is being heated to thermally expand the insulator layer.

In the method of producing a coaxial cable as the third aspect, the metal woven shielding conductor layer is woven while the insulator layer is being thermally expanded. The resultant intermediate cable is thus obtained with the metal woven shielding conductor layer fitted closely to the insulator layer thermally expanded. This prevents the insulator layer from biting into the metal woven shielding conductor layer when it is thermally expanded as the intermediate cable is immersed in the molten metal plating solution. Accordingly, since the metal woven shielding conductor layer is impregnated deeply with the molten metal, there are generated no gaps or undulations on the inner surface of the metal plating layer. Hence, the coaxial cable will be improved in the suppression of reflection and attenuation of a transmission signal. Also, the metal plating layer will hardly be slipped out.

As a fourth aspect of the present invention, a method of producing a coaxial cable is provided in that the coaxial cable produced according to the method of producing a coaxial cable as any of the first to third aspects is reduced in the diameter with the use of a dice or a swaging machine to eliminate the space and thus increase the adhesivity between the insulator layer and the metal plating layer.

In the method of producing a coaxial cable as the fourth aspect, the coaxial cable is reduced in the diameter using a dice or a swaging machine, thus eliminating the space and improving the adhesivity between the insulator layer and the metal plating layer. Accordingly, the coaxial cable will be improved in the suppression of reflection and attenuation of a transmission signal. Also, the metal plating layer will hardly be slipped out.

As a fifth aspect of the present invention, a coaxial cable is provided having an insulated cable produced by coating the outer surface of a center conductor with an insulator layer and covered with a metal plating layer formed by impregnating a metal woven shielding conductor layer with a molten metal and particularly characterized in that the metal plating layer is arranged smooth at its inner surface and adhered closely to the outer surface of the insulated cable.

The coaxial cable as the fifth aspect allows the metal plating layer to be smooth at its inner surface and adhered closely to the outer surface of the insulated cable. Accordingly, the coaxial cable will be improved in the suppression of reflection and attenuation of a transmission signal. Also, the metal plating layer will hardly be slipped out.

BRIEF DESCRIPTION OF THE DRAWINGS

FIG. 1 is an explanatory view showing a process of forming a metal woven shielding conductor in a method of producing a coaxial cable according to a first embodiment of the present invention;

FIG. 2 is a cross sectional view of an intermediate cable of the first embodiment of the present invention;

FIG. 3 is an explanatory view showing a process of molten metal plating in the method of producing a coaxial cable according to the first embodiment of the present invention;

FIG. 4 is a cross sectional view of the coaxial cable of the first embodiment of the present invention;

FIG. 8 is an explanatory view showing a process of forming a metal woven shielding conductor in a method of producing a coaxial cable according to a third embodiment of the present invention;

FIG. 9 is a cross sectional view of an intermediate cable of the third embodiment of the present invention;

FIG. 12 is an explanatory view showing a process of molten metal plating in the conventional method of producing a coaxial cable;

FIG. 13 is a cross sectional view of a conventional coaxial cable; and

DESCRIPTION OF THE PREFERRED EMBODIMENTS

Figure 5:
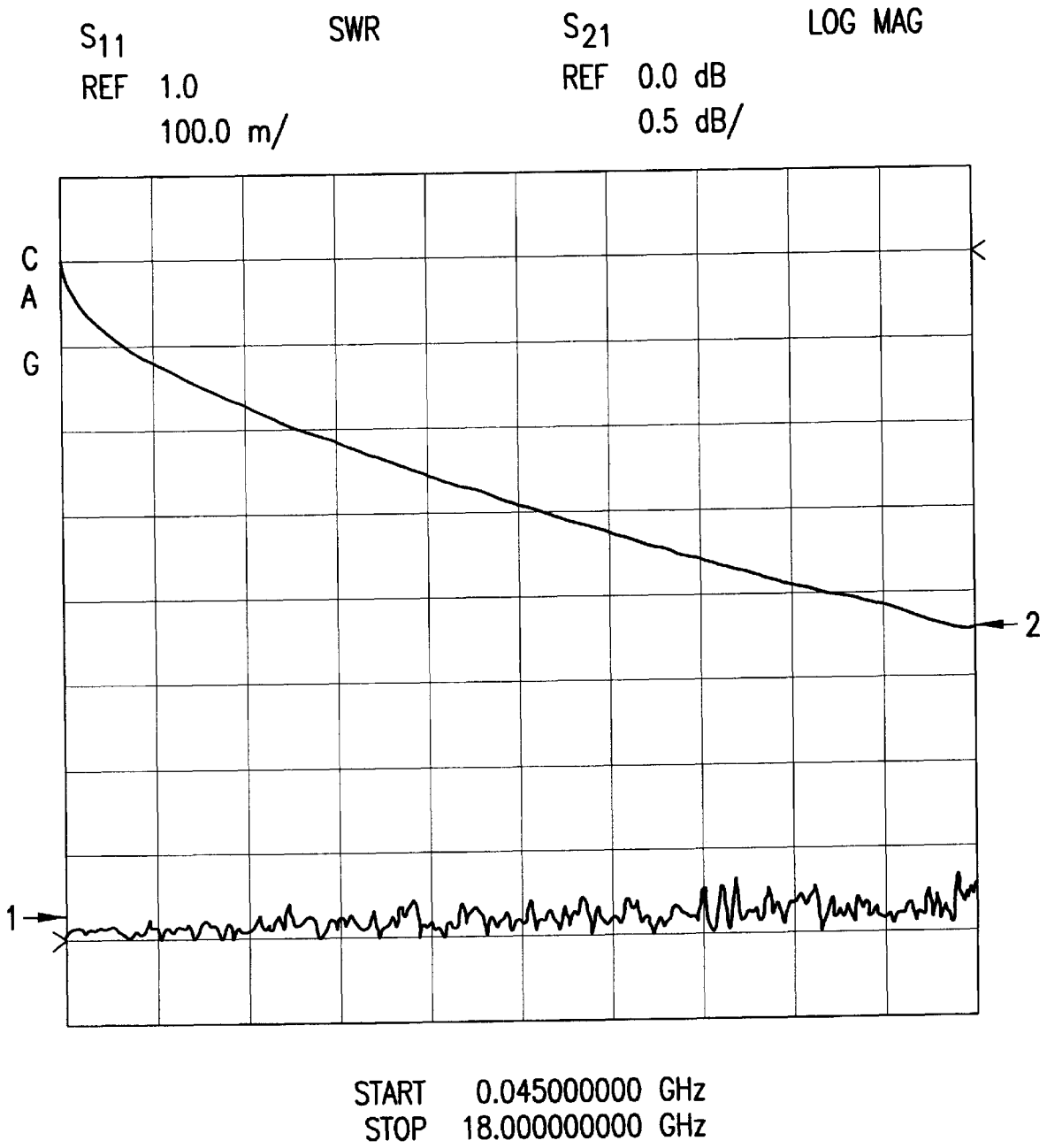
FIG. 5 is a chart showing the attenuation characteristic and the standing wave ratio of a reflected voltage on the coaxial cable according to the first embodiment of the present invention.

Embodiments of the present invention will be described referring to the drawings. The present invention is not limited to the embodiments.

First Embodiment

FIG. 1 is an explanatory view showing a process of forming a metal woven shielding conductor layer in the method of producing a coaxial cable according to a first embodiment of the present invention.

An insulated cable W produced by coating the outer surface of a center conductor (102 in FIG. 2) with an insulator layer (103 in FIG. 2) using a common means at the preceding step is released out from a supply reel 20, passed through a guide roll 21, and directed into a dice 24.

Also, at least one of a solder or tin wire 6 is released out from a solder or tin supply reel 26 and guided into the dice 24 so as to run directly on the insulated cable W.

Simultaneously, a group of metal conductor wires 14 are woven with their corresponding reels 25, on which the metal conductor wires 14 are wound, spinning about the insulated cable W and the solder or tin wire 6 at the entrance of the dice 24 to fabricate a metal woven shielding conductor layer (104 in FIG. 2) over the outer surfaces of the insulated cable W and the solder or tin wire 6.

A resultant intermediate cable 11 having the metal woven shielding conductor layer (104 in FIG. 2) formed on the outer surfaces of the insulated cable W and the solder or tin wire 6 is then taken up on a take-up reel 23 by the drawing action of a drawing capstan 22.

FIG. 2 is a cross sectional view of the intermediate cable 11.

The intermediate cable 11 is provided in which the insulated cable W and the solder or tin wire 6 are covered at their outer surfaces with the metal woven shielding conductor layer 104.

FIG. 3 is an explanatory view showing a process of forming a metal plated layer in the method of producing a coaxial cable according to the first embodiment of the present invention.

The intermediate cable 11 is released out from a supply reel 51 and coated with a flux by a flux coating apparatus 52.

Then, the intermediate cable 11 coated with the flux is passed on a guide roll 53A, directed into a molten metal plating solution 55 in a molten metal plating tub 54, guided by a guide roller 53B in the molten metal plating tub 54, and moved out from the molten metal plating solution 55. During the movement, the metal woven shielding conductor layer 104 of the intermediate cable 11 is impregnated with the molten metal. At the time, the solder or tin wire 6 is dissolved into the molten metal plating solution 55, hence leaving a spatial margin under the metal woven shielding conductor layer 104. This prevents the insulator layer 103 of a resin material from biting into the metal woven shielding conductor layer 104 when it is i- thermally expanded. Accordingly, the metal woven shielding conductor layer 104 is impregnated deeply with the molten metal so that a resultant metal plating layer (105 in FIG. 4) has no gaps and undulations on the inner surface thereof.

The cable is then passed through a plating solution squeezing dice 56 disposed above the molten metal plating solution 55 to determine a desired thickness of the plating layer, cooled down by a cooling apparatus 57, and reduced in the diameter by a diameter reducing dice 60 to complete a coaxial cable 1. The coaxial cable 1 is guided by a guide roll 53C and taken up on a take-up reel 58.

FIG. 4 is a cross sectional view of the coaxial cable 1 produced by the method of producing a coaxial cable according to the first embodiment of the present invention.

The coaxial cable 1 has a structure comprising the metal plating layer 105 which is formed on the outer surface of the insulated cable W, which is produced by coating the outer surface of a center conductor 102 with an insulator layer 103, by impregnating the metal woven shielding conductor layer 104 with the molten metal. Since the molten metal fills the metal woven shielding conductor layer 104, there are generated no gaps and undulations on the inner surface of the metal plating layer 105 and thus the coaxial cable 1 is improved in the suppression of reflection and attenuation of a transmission signal. In addition, the metal plating layer 105 will hardly be slipped out from the cable.

In a desired example, the center conductor 102 is a silver plated copper coated steel wire having an outer diameter of 0.91 mm, the insulator layer 103 is a coating of a ethylene tetrafluoride resin extruded to a thickness of 0.99 mm, the solder or tin wire 6 is 0.3 mm in the outer diameter, and the metal woven shielding conductor layer 104 comprises 16 strands, each consisting of 7 tin plated soft copper wires of 0.1 mm in outer diameter. The intermediate cable 11 has an outer diameter of 3.5 mm.

The molten metal plating solution 55 is a molten tin plating solution having a temperature of 260° C. The time required for passing through the molten metal plating solution 55 is about 6 seconds.

The squeezing dice 56 has an inner diameter of 3.55 mm such that the diameter of a finished plated cable is 3.55 mm in the outer diameter.

The cooling apparatus 57 operates an air-cooling action at an atmosphere temperature of 10° C.

The diameter reducing dice 60 has an inner diameter of 3.47 mm.

FIG. 5 is an exemplary diagram showing the signal attenuation characteristic and the signal reflection characteristic on the coaxial cable 1.

A one-meter length of the coaxial cable 1 was prepared and its attenuation and reflection characteristics at a high frequency range from 0.045 GHz to 18 GHz were measured using a network analyzer.

As apparent, peaks of the attenuation and reflection characteristics which may result from the effect of a winding pitch of the metal woven shielding conductor layer 104 is not shown.

Also, the standing wave ratio of a reflected voltage at the high frequency range from 0.045 GHz to 18 GHz is 1.1 or smaller.

The solder or tin wire 6 has preferably a round shape in cross section but may be an oval, rectangular, or square shape in cross section depending on the application. The solder or tin wire 6 could be made of a tin-lead alloy having a melting point of 350° C. or less, or any other suitable metal or alloy.

It was found from a series of experiments that the cross section of the solder or tin wire 6 was preferably 0.0008 to 0.070 times greater than that of the insulated cable W.

Second Embodiment

Figure 6:
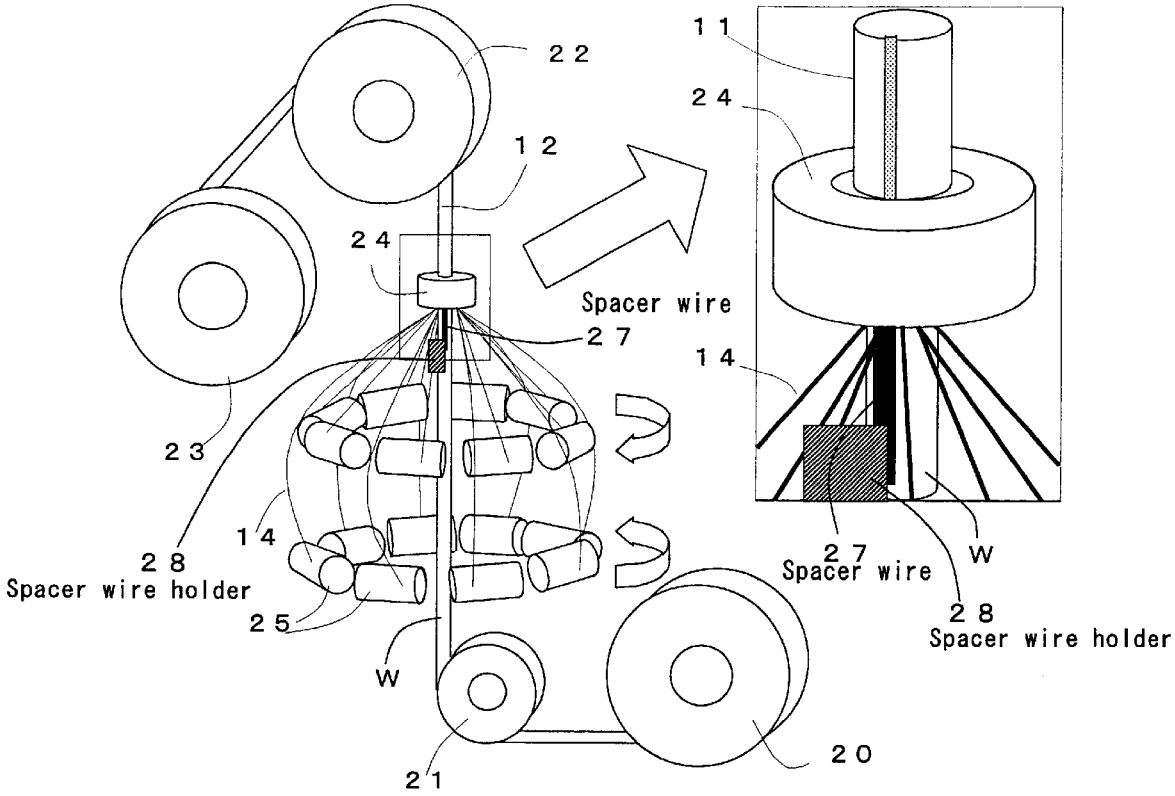
FIG. 6 is an explanatory view showing a process of forming a metal woven shielding conductor in a method of producing a coaxial cable according to a second embodiment of the present invention.

FIG. 6 is an explanatory view showing a process of forming a metal woven shielding conductor layer in a method of producing a coaxial cable according to a second embodiment of the present invention.

An insulated cable W having a center conductor (102 in FIG. 7) coated at its outer surface with an insulator layer (103 in FIG. 7) by a common means at the preceding step is released out from a supply reel 20, passed on a guide roll 21, and directed into a dice 24.

A spacer wire 27 is provided stationary close to the entrance of the dice 24 to come directly on the insulated cable W.

A group of metal conductor wires 14 are woven to form a metal woven shielding conductor layer (104 in FIG. 7) over the outer surfaces of the insulated cable W and the spacer wire 27 while reels 25 on which the metal conductor wires 14 are wound are spinning about the insulated cable W and the spacer wire 27 at the entrance of the dice 24. Because the spacer wire 27 is provided stationary at a location close to the entrance of the dice 24, it stays behind and leaves a space when the insulated cable W has run away from the entrance of the dice 24.

A resultant intermediate cable 12 formed by covering the outer surface of the insulated cable W with the metal woven shielding conductor layer (104 in FIG. 7) and having the space made by the spacer wire 27 in-between is then drawn by a drawing capstan 22 and taken up on a take-up reel 23.

Figure 7:
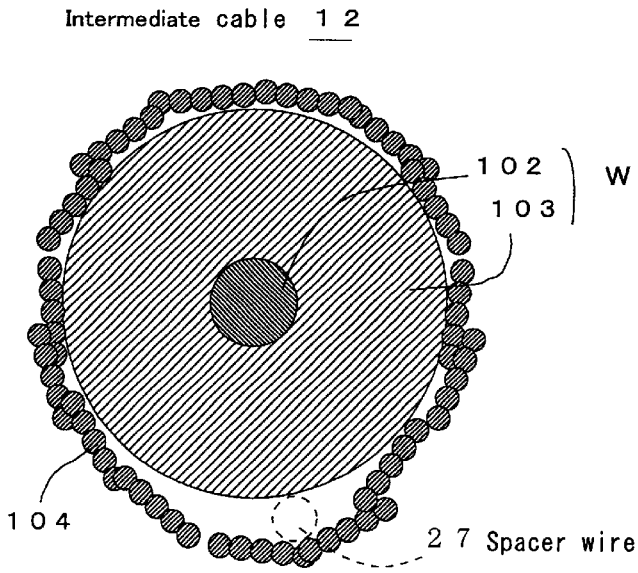
FIG. 7 is a cross sectional view of an intermediate cable of the second embodiment of the present invention.
Figure 10:
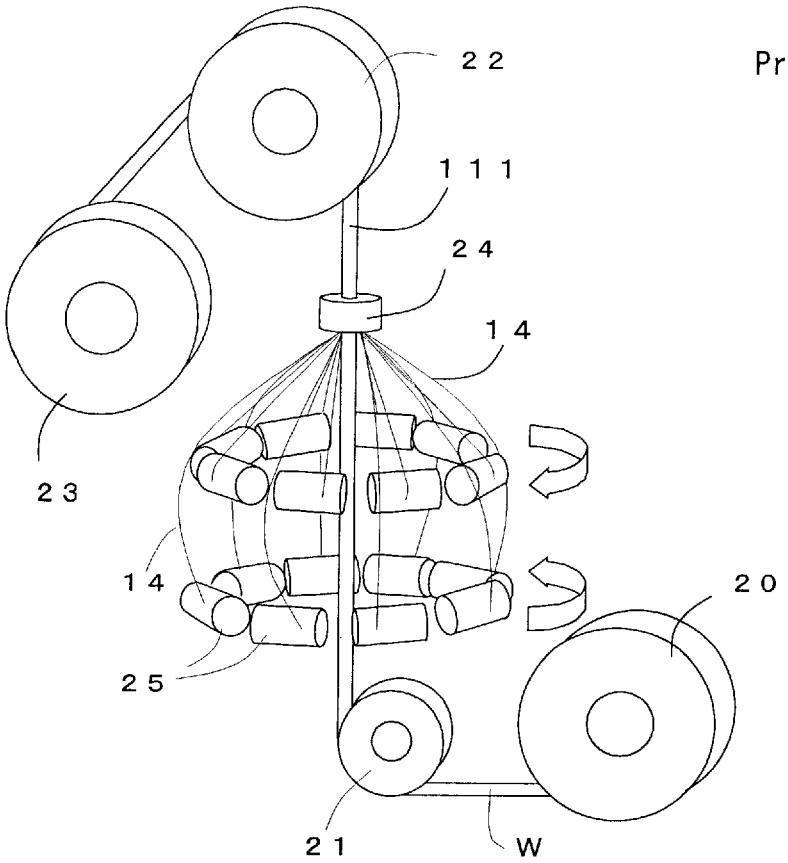
FIG. 10 is an explanatory view showing a process of forming a metal woven shielding conductor in a conventional method of producing a coaxial cable.
Figure 11:
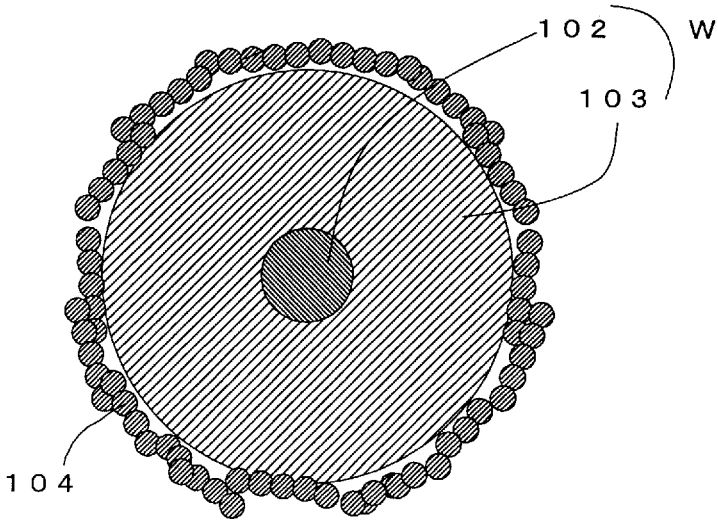
Prior Art Fig. 11
FIG. 11 is a cross sectional view of an intermediate cable of the conventional method.
Figure 14:
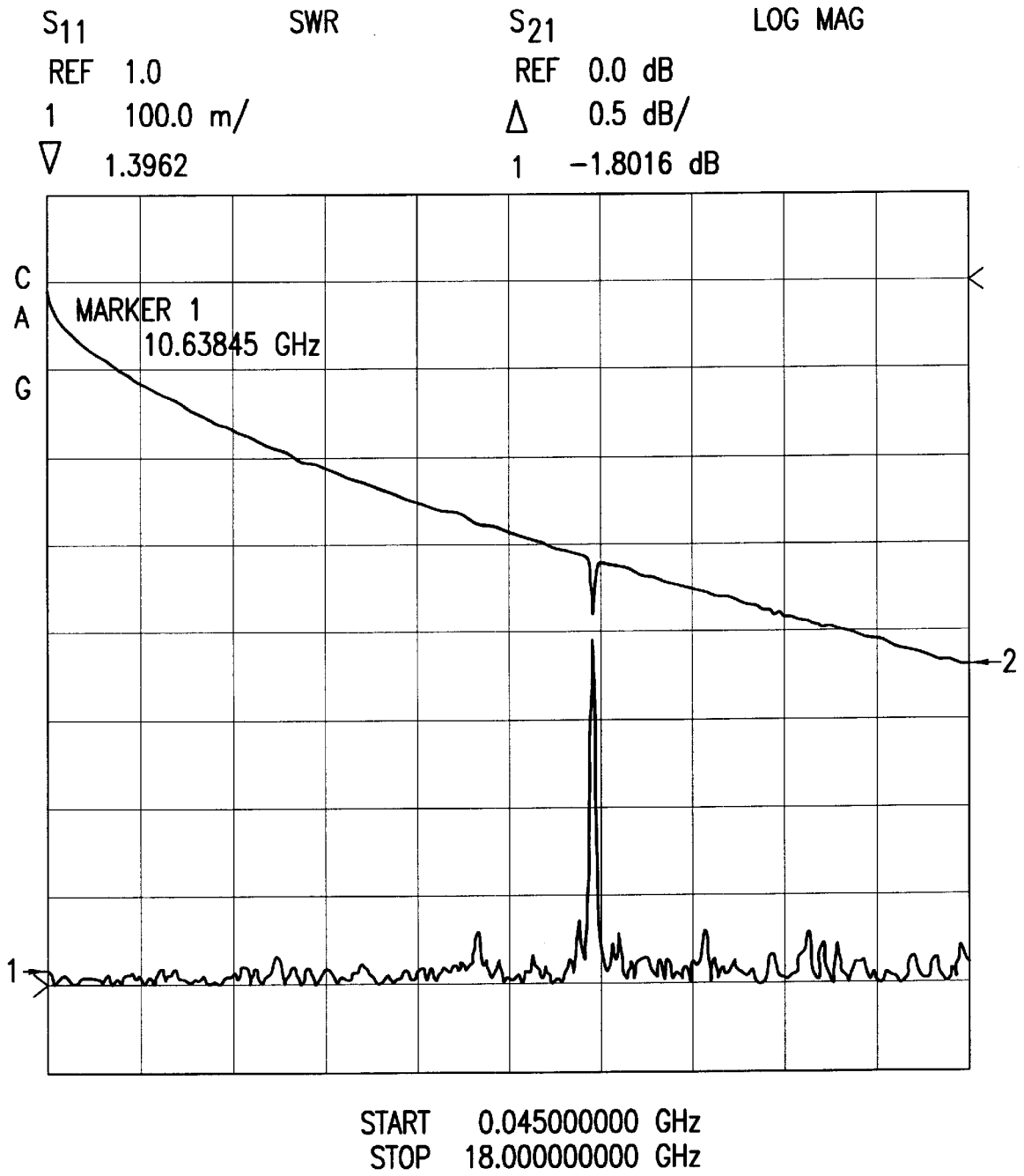
FIG. 14 PRIOR ART
FIG. 14 is a chart showing the attenuation characteristic and the standing wave ratio of a reflected voltage on the conventional coaxial cable.

FIG. 7 is a cross sectional view of the intermediate cable 12.

The intermediate cable 12 has a space provided by the spacer wire 27 on the outer surface of the insulated cable W and covered with the metal woven shielding conductor layer 104.

The process of forming a metal plating layer in the method of producing a coaxial cable according to the second embodiment of the present invention is identical to that shown in FIG. 3.

Since the space under the metal woven shielding conductor layer 104 is provided by the spacer wire 27, the insulator layer 103 of the resin material is prevented from biting into the metal woven shielding conductor layer 104 when it is thermally expanded. This allows the metal woven shielding conductor layer 104 to be impregnated deeply with the molten metal and will generate no gaps or undulations on the inner surface of the metal plating layer (105 in FIG. 4).

A resultant coaxial cable is equal in the quality to the coaxial cable 1 shown in FIG. 4.

In a desired example, the spacer wire 27 is a stainless steel wire having an outer diameter of 0.4 mm. The other components are identical to those described in the previous example.

The spacer wire 27 is preferably round in the cross section and may have an oval or rectangular or square cross section depending on the application. The material of the spacer wire 27 may be other than stainless steel, for example, tungsten.

It was found from a series of experiments that the cross section of the spacer wire 27 was preferably 0.0008 to 0.070 times greater than that of the insulated cable W.

Third Embodiment

FIG. 8 is an explanatory view showing a process of forming a metal woven shielding conductor layer in a method of producing a coaxial cable according to a third embodiment of the present invention.

An insulated cable W having a center conductor (102 in FIG. 9) coated at its outer surface with an insulator layer (103 in FIG. 9) by a common means at the preceding step is released out from a supply reel 20 and passed via a guide roll 21 to a heater 28. A thermally expanded insulated cable W' heated by the heater 28 is then directed into a dice 24.

Also, a group of metal conductor wires 14 are woven to form a metal woven shielding conductor layer (104 in FIG. 9) over the outer surface of the thermally expanded insulated cable W' while reels 25 on which the metal conductor wires 14 are wound are spinning about the thermally expanded insulated cable W' at the entrance of the dice 24. When the thermally expanded insulated cable W' has been cooled down and returned back to the insulated cable W, a spatial margin is generated between the insulated cable W and the metal woven shielding conductor layer (104 in FIG. 9).

A resultant intermediate cable 13 having the spatial margin between the insulated cable W and the metal woven shielding conductor layer (104 in FIG. 9) is drawn by the action of a drawing capstan 22 and taken up on a take-up reel 23.

FIG. 9 is a cross sectional view of the intermediate cable 13.

The intermediate cable 13 has on the outer surface of the insulated cable W the spatial margin for accepting a thermal expansion of the insulated cable W covered with the metal woven shielding conductor layer 104.

The process of forming a metal plating layer in the method of producing a coaxial cable according to the third embodiment of the present invention is identical to that shown in FIG. 3.

Since the spatial margin for accepting a thermal expansion of the insulated cable W is provided under the metal woven shielding conductor layer 104, the insulator layer 103 of a resin material is prevented from biting into the metal woven shielding conductor layer 104 when it is thermally expanded. Accordingly, because the metal woven shielding conductor layer 104 is impregnated deeply with the molten metal, there will be generated no gaps or undulations on the inner surface of the metal plating layer (105 in FIG. 4).

The quality of a resultant coaxial cable is equal to that of the coaxial cable 1 shown in FIG. 4.

In a preferred example, the heater 28 is an electric heater capable of heating the insulated cable W at 260° C. for 20 seconds. The other components are identical to those described in the previous example.

ADVANTAGE OF THE INVENTION

The coaxial cable producing method and the coaxial cable according to the present invention allow the metal woven shielding conductor layer to be impregnated deeply with the molten metal, thus causing the metal plating layer to be improved in the smoothness at the inner surface and its adhesivity to the outer surface of the insulated cable to be increased. Accordingly, the suppression of reflection and attenuation of high frequency signals will highly be enhanced while undesired removal of the metal plating layer is hardly caused.

What claimed is:

1. A method of producing a coaxial cable comprising the steps of: providing an insulated cable formed by coating an outer surface of a center conductor with an insulator layer:

providing at least one of a solder wire and a tin wire adjacent an outer surface of the insulated cable;

providing a metal shielding conductor layer around the outer surface of the insulated cable and the at least one of the solder wire and the tin wire; and passing the insulated cable with the metal shielding conductor layer surrounding the outer surface of the insulated cable and the at least one of the solder wire and the tin wire through a molten metal plating solution to impregnate the metal shielding conductor layer with the molten metal thereby forming a metal plating layer, whereby the at least one of the solder wire and the tin wire melts into the molten metal plating solution.

2. The method of producing a coaxial cable according to claim 1, wherein the metal shielding conductor layer is woven.

* * * * *